US005606987A

United States Patent [19]

Weber

[11] Patent Number: 5,606,987

[45] Date of Patent: Mar. 4, 1997

[54] ENERGY CONSERVING HOT WATER FAUCET DRIBBLE BYPASS METHOD AND APPARATUS

[75] Inventor: Harold J. Weber, Holliston, Mass.

[73] Assignee: Cognidea Patent Trust, Holliston, Mass.

[21] Appl. No.: 413,480

[22] Filed: Mar. 30, 1995

[51] Int. Cl.[6] ..... F16K 11/10

[52] U.S. Cl. ..... 137/1; 137/337; 137/599

[58] Field of Search ..... 137/337, 1, 3, 137/599, 606

[56] References Cited

U.S. PATENT DOCUMENTS 1,734,920 11/1929 Shuell ..... 137/337 X 1,913,622 6/1933 Williams ..... 137/337 X 2,842,155 7/1958 Peters ..... 137/337

3,190,284 6/1965 Koepf ..... 137/337 X

*Primary Examiner*—Stephen M. Hepperle

[57] ABSTRACT

Cold water subrogates hot water supplied to a leaky hot water faucet. An individual kitchen or bathroom faucet set incorporates the anti-dribble control feature to substitute cold water trickle for wasteful hot water trickle through the leaky hot water faucet. When the leaky faucet is turned "off" the supply of hot water feeding the faucet is stopped and a limited flow of cold water replaces the hot water supply to an extent necessary to feed the leaking trickle of water. In effect, usual hot water dribble which may leak through a faulty faucet is eloquently displaced by a sacrifice of cold water.

20 Claims, 3 Drawing Sheets

ENERGY CONSERVING HOT WATER FAUCET DRIBBLE BYPASS METHOD AND APPARATUS

PRIOR ART STATEMENT

Figure 1:
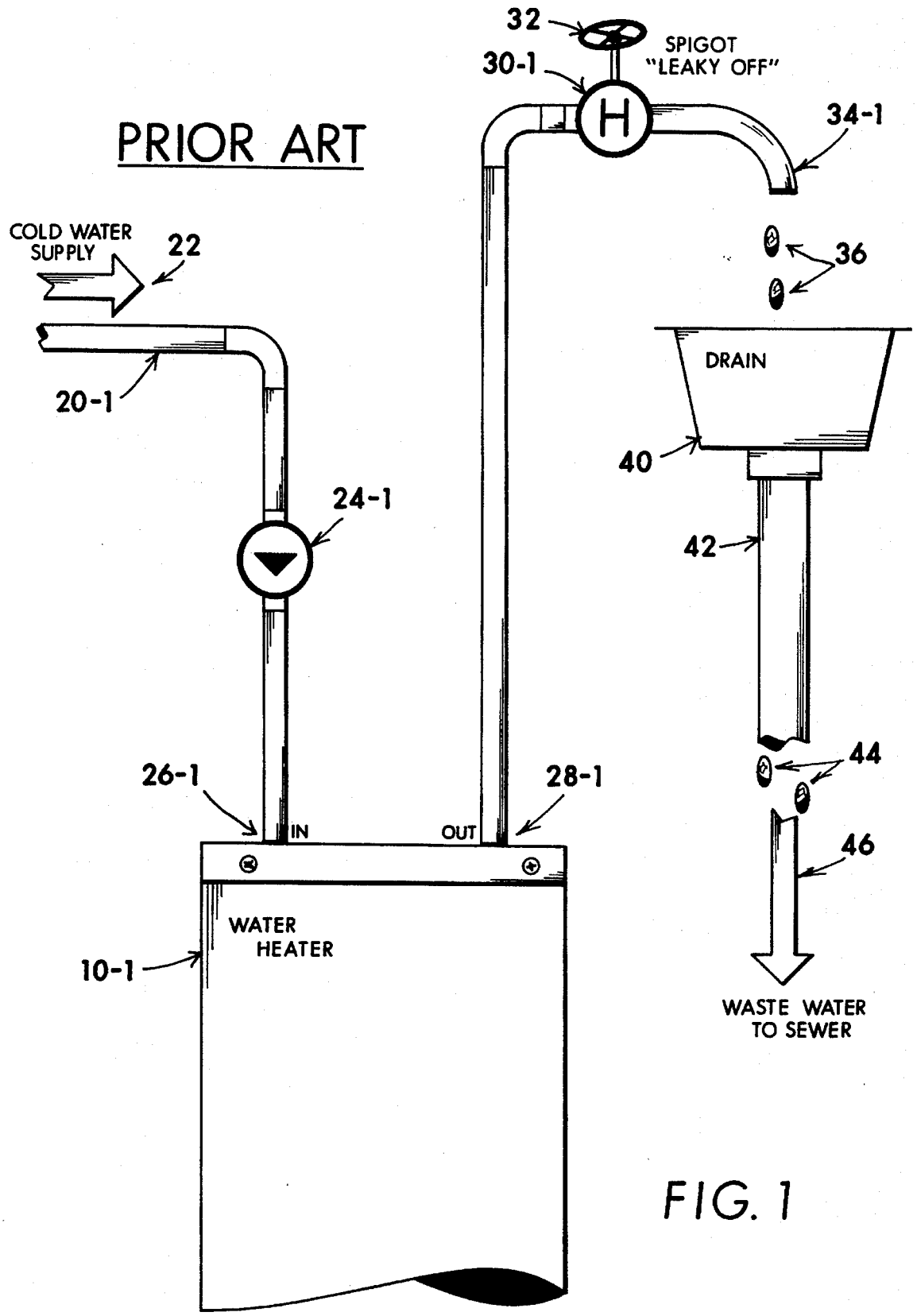

This inventor is not currently cognizant of any previous patents or other prior art particularly relating to the field of this invention except for those prior art patents which have been cited.

BACKGROUND OF MY INVENTION

Defective hot water faucets are known to unecessarily leak and dribble a lot of hot water and as a result, cause a big waste of energy which is used for heating the water. While it might be reasonable to presume that a leaking spigot can be readily repaired, reality dictates that many small-appearing faucet leaks are simply ignored or overlooked for long periods of time. Neglect occurs for several reasons. Inconvenience involving the difficulty and expense for obtaining a reliable repair person is one. Another is that the amount of hot water which drip away as waste is not apparent and the magnitude of the wasteful cost for heating the dribbling hot water is not appreciated, although it might easily amount to over ten dollars a month for each leaking tap. Additionally, in rented accomodations, no particular concern is felt by a tenant that a considerable amount of hot water is being wasted, particularly if a landlord is paying for heating the water. In effect it becomes "someone elses problem" and nothing is done to effect a repair of a leaky tap valve, especially in view that the landlord has no way of realizing or readily becoming aware of the fact that a spigot may be defective and wasting energy. Lastly, there is a sense of helplessness accompanied by annoyance in that frequently even if a faucet is repaired or replaced, usually at considerable expense, the drip or trickle may soon return and the owner is faced with yet another repair bill and no assurance of a lasting fix.

A defective, leaking faucet may take many forms. While it is obvious that an old, obsolete tap design may invite leakage merely due to deterioration or inefficient design, it is not only these "older" taps which pose a leakage problem. Relatively new or replacement faucets may also exhibit leakage due to seat corrosion or rubber washer failure, each of which are in principle easy to repair, but which in practice require a level of skill and knowledge which might overreach that of the owner or tenant thereby necessitating the hiring of a plumber or repair person, usually at substantial expense. So called "leakproof" or "washerless" valve designs may incur unexpected leakage due to the seal surfaces becoming scored, perhaps from sand and grit in the water supply itself. Even "brand new" (e.g., newly installed or newly repaired) faucets which include my invention may exhibit premature leakage due to seal damage or early rubber washer failure, particularly due to the deteriorative stress and accelerated oxidation produced by the hot water. Some ordinary hot water tap designs also merely exhibit a propensity for being difficult to fully turn-off (e.g., excess stiffness or tightness of stem seals, etc.) and as a result, they are often left slightly-on permitting a persistent trickle and hot water waste. This latter cause for leakage is particularly problematic when the hot water tap is routinely operated by small children or elderly persons, either of which may have less hand strength than what it takes to "tightly" turn the offending spigot fully "off". Such an otherwise nondefective spigot may quickly account for the waste of hundreds of gallons of heated water every month.

I have observed many of these kinds of wasteful circumstances over a period of time. I have discovered the problem to be most troublesome with ordinary hot water taps, most likely due to the deteriorating effect of hot water upon rubber (or plastic) washers and brass seats commonly used in the construction of these ordinary types of tap valves. I have envisioned that, if it were possible to divert cold water through the leaking spigot instead of hot water, then the leak itself would at least not waste energy used for heating the water. What this says is that while defective faucets which include my invention may not necessarily be promptly repaired, at least the energy loss and cost impact of the leak can be minimized. As a result, the cost of water heating fuel wasted by an unavoidably leaking faucet may be truly minimized.

ENERGY WASTE CONSIDERATIONS

A continual drip or trickle of hot water from a kitchen or bathroom hot water tap is not an unusual occurance, particularly in older or poorly maintained housing. The cost of this continous waste is surprising and adds considerably to the total water heating fuel cost.

Consider the Known Factors to heat one gallon of water merely one degree (farenheit) requires about 8.35 BTUs (British thermal units) of energy.

one kilowatt-hour of electricity produces about 3413 BTUs.

a faucet leaking a trickle of one gallon of water per hour (not an exceptional amount) ultimately leaks about 1 gal ×24 Hr ×30 day =720 gallons of water per month.

electricity to heat water may cost about 10.8 cents per KWH (Rate "R1" March 1994, Boston Edison Co., 800 Boylston St., Boston, Mass.). Cost of gas or other fuels, per BTU and allowing for heating apparatus inefficiencies is comparable.

cold water entering a water heater might have an incoming temperature of 65 degrees farenheit.

hot water exiting a water heater may have been heated to 140 degrees farenheit. this means about 720 gallons of water has to be heated (140–65)=75 degrees (F) during the typical month, therefore:

$$\frac{720\text{ gal.} \times 75^\circ\text{ F.} \times 8.35\text{ BTU}}{3413\text{ BTU}} \times \$0.108 = \$14.27\text{ per month}$$

A surprising cost comparison to other leakage rates is:

| EACH FAUCET | EACH FAUCET COST | | |
|---|---|---|---|
| LEAK RATE PER HOUR | DAILY COST | MONTHLY COST | ANNUAL COST |
| 1 gallon | $.47 | $14.27 | $171.24 |
| ½ gallon | .24 | 7.13 | 85.56 |
| 1 quart | .12 | 3.57 | 42.84 |
| 1 cup (8 fl. oz.) | .03 | .89 | 10.70 |

Based upon ELECTRIC WATER HEATING with a typical cost of electricity 10.8 cents/KWH, incoming water temperature 65° F.; hot water heated to 140° F. temperature; continuous tap leakage 24 hours a day.

Hot water heating with gas shows comparable costs. Hot water heating using "solar panels" or other "alternate energy" sources involves an even more objectionable consideration in that the reserve of solar heated hot water might simply leak away, leaving no hot water supply available for practical usage.

SUMMARY OF MY INVENTION

My invention's essence provides for the sacrificial substitution of a controlled leak of COLD water for an uncontrolled leak of HOT water in order to conserve the hot water in event of a leaky faucet valve. A fundamental premise upon which my invention is based is that it is far less wasteful of energy resources and in the end less costly to a user to dribble away a quantity of cold water than what it is to first heat and then dribble away a similar quantity of hot water. It is not the goal of this invention to fully stop an otherwise unavoidably leaking hot water tap, valve from leaking, but rather my invention, when included in the design of the faucet, diverts a sacrificial flow of cold water through the leaking hot water spigot and thereby blocks an energy intensive and economically more wasteful trickle of hot water.

A leaking tap valve may take many forms, but the most common instance is that of a leaking spigot having a defective rubber washer seal, sometimes accompanied by a defective "seat". On occasion the rubber seal washer "cracks"; othertimes the rubber washer "hardens" and looses its necessary compliancy necessary for sealing tightly against the mating seat. Valve seats also corrode, especially in presence of heated water where any chemical components present in the water (such as ammonia) can cause accelerated deterioration of a brass seat. A typical condition for deterioration of a brass seat is for the brass to become "grainy" and porus increasing the friction with the mating washer which ultimately ends up in chewing up the mating surfaces of the washer and loss of sealability. The result is a slight leak appearing as drips now and then. Although small, this leak may draw at least warmed water through the faucet, adversely accelerating the breakdown and failure of the brass seat by the effects of water-borne chemicals leaching away the zinc component of the brass and the leak gradually but progressively grows from a mere drip to a full-fledged trickle.

Conversely, the subrogation of cold water for a trickle of hot water that might dribble from the spout of an individual hot water spigot might be included into combination HOT and COLD mixing faucet assemblies contemporaneously used in kitchens and bathrooms. The apparatus elements necessary to obtain efficient hot water subrogation by an equivalent flow of cold water might be included as an integral part of the mixing faucet assembly.

Subrogation of cold water for hot water immediately at the offending faucet assembly (e.g., at a kitchen or bathroom sink, bathtub, etc.) has the further advantage of not bleeding cool or cold water through the hot water pipe run intercoupled between the water heater outlet and the faucet inlet as will be the usual case if the diverting device is installed near the water heater's heated water outlet such as taught by Shuell in U.S. Pat. No. 1,734,920.

Where installation near the water heater heated water outlet inhibits a trickle of hot water through the water heater but the hot water already confined within the hot-water supply pipe to a spigot is bled off as cold water supplants the heated water while the hot water continues to leak forth from the spigot albeit gradually cooling off as the cold water continues to supplant the leak. As a result, if a person desires to draw a full flow of hot water from the spigot the full run of cooled-off hot water will have to be drawn before fully heated water arrives at the spigot for an intended use.

With my invention, installation of the conserving device near or within the faucet assembly servicing a sink or basin results in almost immediate subrogation of any hot water which might leak from a faulty tap valve while the heated water held in the hot water pipe run between the water heater and the faucet assembly inlet is not diluted with cold water. As a result, when a person again turns the hot water spigot on, almost immediate hot water will appear and no wasteful draw-off of the cooled off water in the hot water supply pipe run may be necessary.

With my invention's conserving device near the faucet assembly that may advantageously prevent delay in obtaining a full flow of hot water, it shall be realized that either approach conserves a substantial amount of hot water and energy usage as compared to prior art where a leak merely continued without subrogation or intervention.

OBJECTIVES OF MY INVENTION

A central objective of my invention is to thwart waste of energy through the subrogation of cold water for hot water that may trickle through a leaky although substantially turned-off hot water valve.

Another objective for my invention is to overcome the economic loss wrought by a continual flow of hot water wasting from a leaky spigot.

A purpose of my invention is to teach how a trickle of cold water may be efficiently utilized to subrogate a wasteful flow of heated water through a turned-off but leaky water valve.

An aspect of my invention is to utilize a restricted minor flow of water to crossover between a source of cold water and a hot water valve to supplant a minor flow of hot water through the hot water valve and thereby supplant issue of a dribble of hot water from a leaky albeit turned-off spigot controlled by the valve with cold water for the purpose of saving water heating energy.

Still another objective for my invention is to teach the subrogation of a minor flow of cold water through hot water faucet to overcome an otherwise wasteful parasitic trickle of hot water which may be drawn through the leaky turned-off hot water faucet and to inhibit the minor flow of cold water in response to an occurrance of substantial water flow through the hot water faucet such as obtained when the hot water faucet is turned partly or fully on.

A principle advantage afforded by my invention is the conservation of large quantities of expensively heated water, by substitution of similar quantities of less costly cold water, which may leak through an untended defective hot water faucet.

It is these foregoing aspects and other goals and advantages of my invention which are hereinafter described by way of a specification, drawings and claims.

DESCRIPTION OF MY DRAWINGS

This invention is depicted on 10 sheets of drawings showing 15 figures:

FIG. 1—Prior art hookup of a hot water supply is shown, including the "leaking off" spigot problem which wastes energy.

Figure 2:
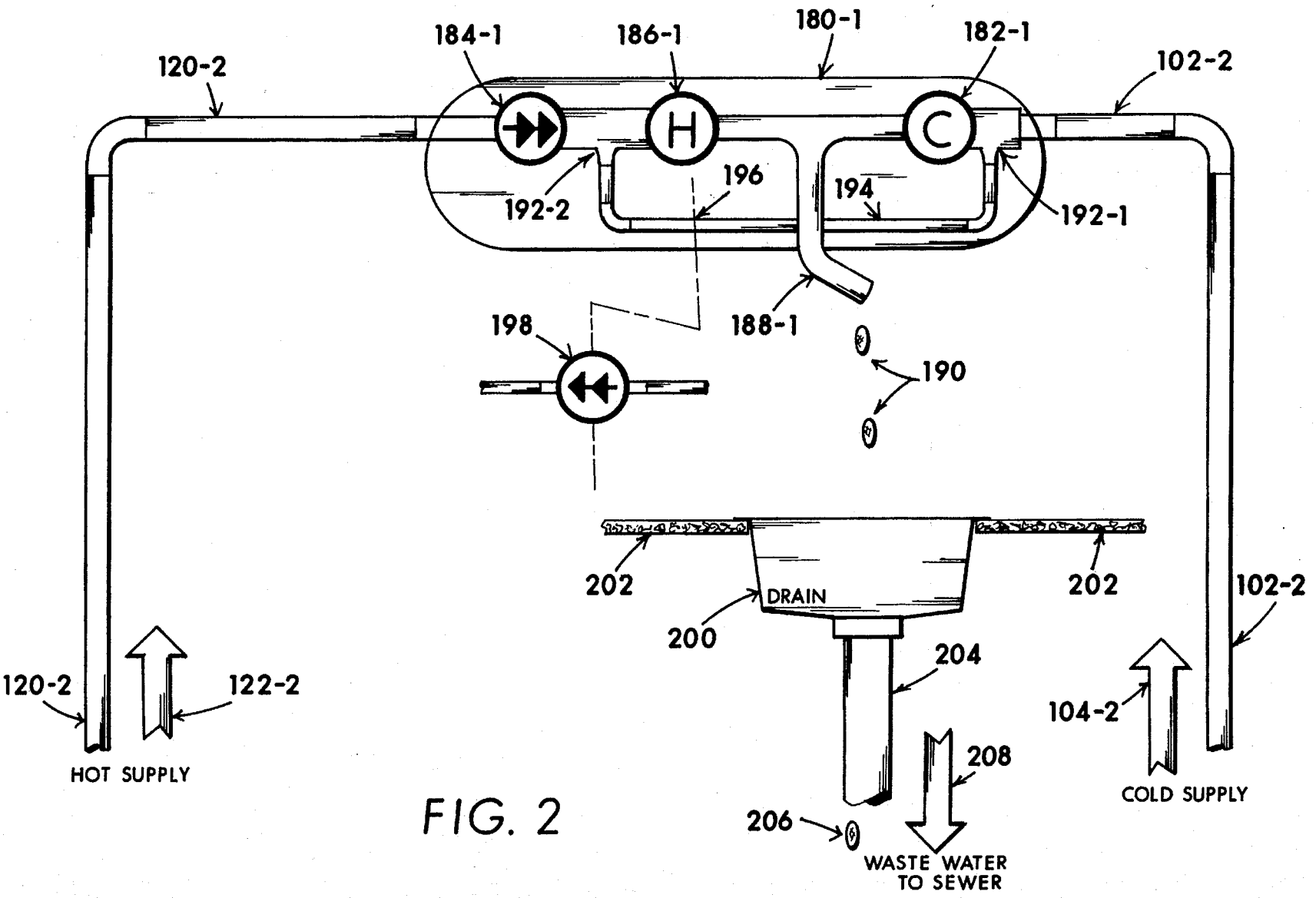

FIG. 2—Combination faucet set having an anti-dribble control device arrangement integral with the faucet set.

Figure 3:
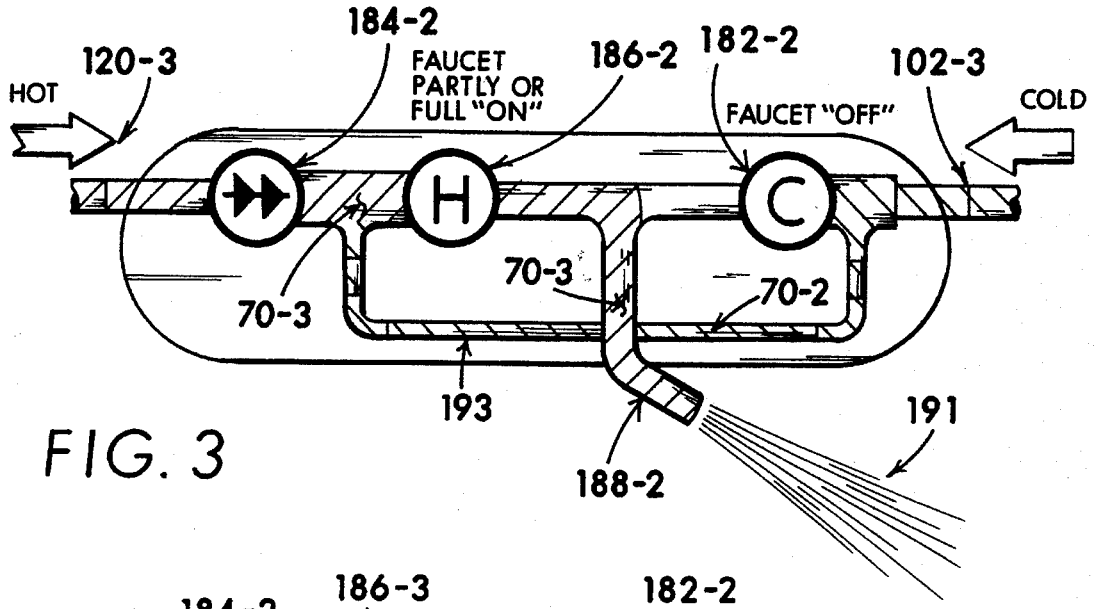

FIG. 3—Hot water flow through the combination faucet set when the hot valve is partly or fully on.

Figure 4:
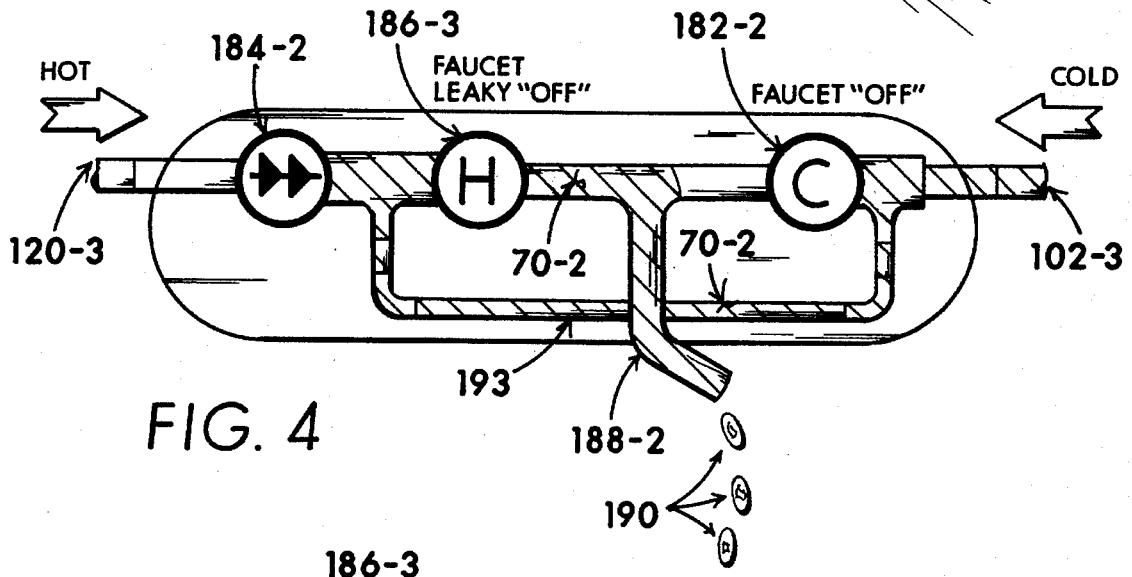

FIG. 4—Cold water path through a leaking combination faucet set when the leaky hot valve is turned off.

Figure 5:
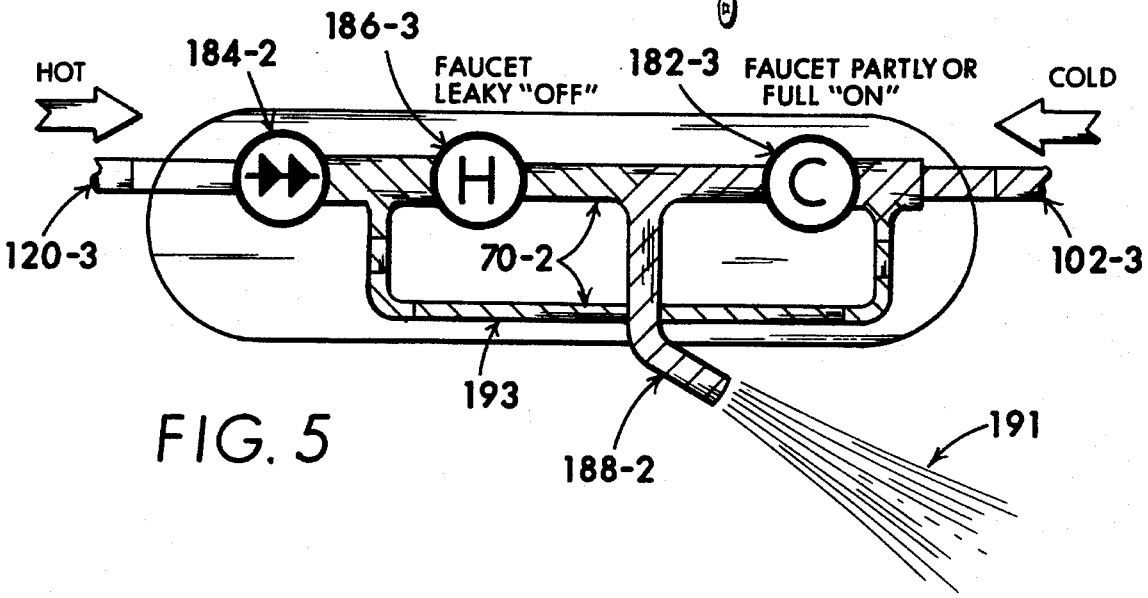

FIG. 5—Cold water path through the combination faucet set when the cold water valve is mostly or fully on and the hot water valve is off, albeit leaking.

DESCRIPTION OF MY INVENTION

In a usual PRIOR ART water heater installation depicted by FIG. 1, considerable energy can be lost when a water heater 10-1 feeds a leaky faucet valve 30-1. Although the handle 32 of the valve may be manually turned off to an "OFF" position, a defective washer, seat or other flaw in the valve shut-off mechanism may leave a persistent leak through the valve resulting in drips 36 or even a steady trickle of hot water from the valve spout 34-1. Leaking valve mechanisms are well known in the plumbing art and therefore are not necessarily expanded upon except to say that the valve, faucet, tap or water cock mechanism in fact leaks due to an inability to fully shut the valve off which is usually brought about by ordinary wear, deterioration or defect. Substantial energy loss occurs because the cold water inlet pipe 20-1 produces a flow 22 of cool water (typically between about 50° F. and 75° F.) through a check or service valve 24-1 (which is normally fully-on) and into the inlet 26-1 of the water heater 10-1. The cool water is heated, usually to a temperature in the range of 140° F. and 170° F., whereupon it flows forth from the outlet 28-1 and towards the valve 30-1 to supply the trickle or drip. The wasted dribble of water is usually caught in a basin 40 or sink from which it flows through a drainpipe 42 as a leak of wastewater 44 that typically ends up flowing 46 to a sewer system.

The workings of an anti-dribble control device may be incorporated directly in the structure of a set of faucets. I find that this is the most effective, convenient and possibly cost effective arrangement in that a quality set of faucets may offer anti-dribble hotwater conservation without introducing much in the way of added complexity or manufacturing cost. In my FIG. 2 I show that a faucet set 180-1 including the usual cold water valve 182-1 and hot water valve 186-1 may be improved into conserving a wasteful flow of hot water through the hot water valve when the hot water valve has developed a minor leak. As a result, although the hot water valve 186-1 may slightly leak when off, the driplets 190 which issue from the faucet set spout 88-1 will merely waste as driblets 190 or a trickle of cold water and as a result save on water heating energy. Water lost due to the leaking water spigot ordinarily dribbles 190 into a basin 200 (such as a kitchen sink which may be mounted into a counter 202) and outflows through a drainpipe 204 as wastewater 206 that may flow to a sewer 208.

A supply of cold water 104-2 couples in through a line 102-2 with the faucet set, and in particular the cold valve 182-1. A supply of heated water 122-2 is provided through a line 120-2 that couples through a pressure responsive check valve 184-1 with the hot valve 186-1. Additionally, a small pipe 194 may couple between a minor water connection 192-1 in the cold water supply line and a connection 192-2 with the hot water line. Ordinarily it is the intent of this small pipe 192-1 to act as a restriction to retard water flow between the incoming cold water connection 192-1 and the outlet into the hot water line. Aside from the restrictive effect of the piping 194, a separate restrictor may be included (but not shown) to provide flow-rate control. Use of restrictor apertures for this purpose is well known in the art and needs no particular explanation.

The small pipe 194 may further include a pressure responsive check valve 198 which is ordinarily installed in the small pipe near the position shown by the broken line intersection 196 with the small pipe 194. Ordinarily, the pressure responsiveness of this check valve 198 is substantially less (lower PSI differential) than what the main pressure responsive check valve 184-1 operates with. Overall operation of this faucet set occurs in three main states:

When the cold spigot is off and the hot spigot is partly or fully on as depicted by FIG. 3 hot water flows into the pressure responsive check valve 184-2. With the hot spigot 186-2 opened, a pressure drop appears across the check valve 184-2 sufficient to open the valve and enable a substantially full flow 70-3 of hot water through the check valve and the hot spigot which will issue 191 from the spout 188-2 as hot water. Cold water is provided 102-3 to the cold water spigot, but is blocked from flowing through the spigot. A portion of the cold water (restricted to several percent of the available cold water flow) feeds through a connecting pipe or port 193 and inmixes with the flow of hot water with the only effect being that to slightly moderate the issued hot water 191 temperature by a few degrees. If the pressure responsive check valve 198 is included in series with the connecting pipe 193, as depicted in FIG. 2 by coupling of the check valve 198 with the equivalent small connecting pipe 194, the check valve 198 closes thereby blocking cold water spillage into the hot water flow. The check valve 198 is shown preferably nearer the hot water valves 184-1, 186-1 to allow for more restriction on the cold water side of the check valve 198. This arrangement may provide more definitive operation of the check valve 198 when the faucet valve 186-1 is turned on and flow occurs through the valves 184-1, 186-1.

When both the cold and hot water spigots are turned off, a state as depicted by FIG. 4 occurs when the hot spigot is leaky. A small trickle flow 70-2 of water continues through the leaky hot spigot 186-3. Since a restricted flow or cold water passes through the tube 193, differential pressure across the pressure responsive check valve 184-2 is about equalized with the result that the check valve remains closed. The result of this that while water leaks through the hot spigot 186-3 and issues forth 190 from the faucet spout as waste water, the leakage water is obtained from the cold water supply line and it does not require replenishment from the heated water supply 120-3.

With the cold spigot turned partly or fully on as depicted now in FIG. 5, a full flow 70-3 of cold water flows through the cold spigot and issues 191 from the spout 188-2. A small portion 70-2 of cold water may also continue to flow through the crossover pipe 193 and leak through the leaky hot spigot 186-3. However, this minor flow 70-3 of cold water leaking through the hot faucet merely combines with the cold water rushing through the cold spigot 182-3 and issues from the spout 188-2.

Although I teach several forms for my invention as depicted in the accompanying figures and description, this by no means shall be construed or inferred as limiting the scope of my invention to these particular combinations of elements or structual configurations. It is the utter essence of my invention to teach an anti-dribble hot water conservation method and to give example of embodiment apparatus suitable for teaching subrogation of a wasteful trickle of energy intensive hot water through a leaking faucet with a less wasteful trickle of unheated water. Realize also that the implementation of my apparatus might take other forms which can be engineered or adapted by a skilled artisan to suit a particular application or take advantage of specific hardware components or techniques without departing from the underlying spirit of my invention. It is also necessary that when I give specific operating temperatures for the representative operation of hot water equipment associated with my apparatus or when I call for particular arrangements of plumbing devices that these definitions and examples of known trade devices and physical values are guidelines which may serve to illustratively teach the art which I have developed to others but should not be construed as limiting or regulatory regarding the operative essence of my invention. At most, they should be understood merely being hookup examples which I have found suitable in practicing several forms of my invention. Additionally, the artisan shall understand that my invention is not solely limited to hot water flow systems, but the produced effects may be extended to liquid flow systems in general in which the subrogation of one fluid form for another fluid form may effect conservation of one of the fluid forms. Furthermore, I anticipate that mere variations of this invention may be implemented which can beneficially work with fluids of virtually any type, including gases.

It shall be understood that whatever choice of plumbing or fluid handling devices, component configurations, physical embodiments or arrangements., materials, sizing or other matters of style or technique are employed these shall be considered as mere engineering, artisan or craftsperson choices, whether generally known in the trade or not, used as options to satisfy a specific application for or implementation of my invention and such choices shall be considered to be fully within the scope of my claimed invention. Henceforth, terms representing "hot water" and "cold water" merely reflect a particular terminology for widely used fluid forms employed in a ubiquity of domestic hot and cold water systems and that as such representations, the terms as utilized in this teaching are intended to more generally apply to any two or more liquid forms of any description whatsoever.

What I claim is:

1. Method for sacrificing a trickle flow of unheated water for a trickle flow of heated water wasting through a turned-OFF leaky hot water valve, comprising steps of:

inhibiting an available flow of heated water between a hot water source supplied through a hot water pipe run and the turned-OFF leaky hot water valve;

substituting a flow of unheated water to effectively supplant the inhibited flow of heated water;

injecting the substitute flow of unheated water immediately into juncture between the hot water pipe run and supply inlet of the leaky hot water valve; and, wasting the substituted flow of unheated water through the turned-OFF leaky hot water valve.

2. Method of claim 1 comprising further steps of:

turning-ON the hot water valve to be at least partly open; and, enabling the available flow of heated water to supply the turned-ON said hot water valve.

3. Method of claim 2 comprising a further step of:

blocking the substitutive said flow of unheated water to the turned-ON said hot water valve.

4. Method of claim 1 comprising a further step of:

blocking flow of the heated water through the hot water pipe run between the hot water source and the turned-OFF leaky hot water valve.

5. Method of claim 1 comprising further steps of:

arranging a cold water valve and the hot water valve to produce issue through a common spout;

supplying the cold water valve with a supply of unheated water; and, directing a portion of the unheated water supply to provide the substitute flow of unheated water through the turned-OFF leaky hot water valve.

6. Method of claim 5 comprising further steps of:

turning-ON the hot water valve to be at least partly open;

enabling the available flow of heated water to supply the turned-ON said hot water valve; and, blocking the substitutive flow of unheated water to the turned-ON said hot water valve.

7. Method for substantially reducing a wasteful flow of heated water trickling through a turned-OFF leaky hot water valve by substituting a sacrificial flow of unheated water, comprising the steps of:

coupling a source of heated water through a heated water pipe run and with an inlet portion of the hot water valve;

inhibiting a supply of heated water through the heated water pipe run and to the turned-OFF leaky hot water valve; and, supplying the sacrificial flow of unheated water directly to a juncture between the heated water pipe run and the inlet portion of the turned-OFF leaky hot water valve to thereby subrogate the inhibited supply of heated water.

8. Method of claim 7 comprising further steps of:

sensing at least partial turn-ON of the leaky hot water valve; and thereupon, enabling substantial flow of heated water supply through the heated water pipe run and the hot water valve.

9. Method of claim 8 comprising a step of:

inhibiting the sacrificial flow of unheated water to the hot water valve substantially concurrent with the sensed said turn-ON of the hot water valve.

10. Method of claim 7 comprising further steps of:

supplying a water heater with unheated water;

blocking a trickle flow of heated water which may draw through the heated water pipe run between the water heater and the turned-OFF leaky faucet; and, water substituting a trickle flow of unheated water between the unheated water supply and a juncture between the the heated water pipe run and inlet of the turned-OFF leaky faucet.

11. Method of claim 7 comprising further steps of:

arranging a cold water valve and the hot water valve to produce issue through a common spout;

supplying the cold water valve with a supply of unheated water; and, directing a portion of the unheated water supply to a juncture between the heated water pipe run and the inlet of the hot water valve to provide the sacrigicial flow of unheated water as a tricklet through the turned-OFF leaky hot water valve.

12. Method of claim 11 comprising further steps of:

turning-ON the hot water valve to be at least partly open;

enabling the flow of heated water to supply the turned-ON said hot water valve; and, blocking the sacrificial flow of unheated water to the turned-ON said hot water valve.

13. Apparatus for reducing a trickle flow of heated water wasting through a turned-OFF leaky hot water valve means and comprising:

means for supplying heated water and including a heated water pipe run means coupled with the hot water valve means;

means for inhibiting the trickle flow of heated water to the turned-OFF said hot water valve means; and, means for supplying a juncture between the heated water pipe and inlet of the hot water valve means with a proportionate sacrificial flow of unheated water to subrogate the inhibited said trickle flow of heated water leaking through the turned-OFF said hot water valve means.

14. Apparatus of claim 13 further comprising:

means for sensing at least partial turn-ON of the hot water valve means; and, means enabling the substantial flow of heated water to flow through the heated water pipe run means and supply the hot water valve means in response to the sensed at least partial turn-ON of the hot water valve.

15. Apparatus of claim 14 further comprising:

means for blocking the sacrificial flow of unheated water upon sensing at least partial turn-ON of the hot water valve means.

16. Apparatus of claim 13 further comprising:

means for heating water having an inlet means coupled with a source of unheated water and an outlet means coupled through the heated water pipe run means with the hot water valve means;

means coupling an available tricklet of unheated water with a juncture between the pipe run means and inlet of the hot water valve means;

means for disabling flow of water through the heated water pipe run means when the water flow through the turned-OFF leaky hot water valve means is sensed as having a rate predetermined as a dribble; and, means for substituting the available tricklet of unheated water for the dribble flowing through the turned-OFF leaky hot water valve.

17. Apparatus of claim 13 further comprising:

means including a cold water valve means and the hot water valve means conjoined to produce issue from a common spout means;

source of unheated water coupled with the cold water valve means; and means for coupling a predetermined tricklet of the unheated water with a juncture between the heated water pipe run means and an inlet of the hot water valve means to provide the substitute flow of unheated water.

18. Apparatus of claim 17 further comprising:

means for turning-ON the hot water valve; and, means for enabling a substantial flow of heated water to flow through the heated water pipe run means and supply the turned-ON said hot water valve.

19. Apparatus of claim 18 further comprising:

means for blocking the substitute flow of unheated water to the turned-ON said hot water valve.

20. Apparatus of claim 13 further comprising:

means enabling a subrogative trickle of unheated water flow to feed a juncture between the heated water pipe run means and inlet portion of the leaking turned-OFF hot water valve while effectively blocking substantative flow of water through connective pipe means coupled between a source for the heated water and the immediate inlet of the hot water valve means.

* * * * *